US008256167B2

(12) United States Patent
Braybrook

(10) Patent No.: US 8,256,167 B2
(45) Date of Patent: Sep. 4, 2012

(54) SOLAR-SHADING ASSEMBLY WITH HIDDEN FASTENING DEVICE

(75) Inventor: Peter Braybrook, Gloucester (GB)

(73) Assignee: Levolux A T Limited, Gloucester (GB)

( * ) Notice: Subject to any disclaimer, the term of this patent is extended or adjusted under 35 U.S.C. 154(b) by 352 days.

(21) Appl. No.: 12/571,784

(22) Filed: Oct. 1, 2009

(65) Prior Publication Data

US 2010/0088960 A1 Apr. 15, 2010

(30) Foreign Application Priority Data

Oct. 14, 2008 (GB) ..... 0818750.2

(51) Int. Cl.
*E06B 7/08* (2006.01)

(52) U.S. Cl. ..... 52/75; 52/78; 52/473

(58) Field of Classification Search ..... 52/74, 75, 52/78, 473; 49/74.1, 92.1, 403
See application file for complete search history.

(56) References Cited

U.S. PATENT DOCUMENTS

| | | | | |
|---|---|---|---|---|
| 1,340,252 | A * | 5/1920 | Rasmussen | 49/74.1 |
| 3,004,306 | A * | 10/1961 | Hallock | 52/473 |
| 3,438,167 | A * | 4/1969 | Royston, Jr | 52/473 |
| 5,187,896 | A * | 2/1993 | Ross | 49/74.1 |
| 5,548,925 | A * | 8/1996 | Marocco | 49/74.1 |
| 6,098,340 | A * | 8/2000 | Francis | 49/74.1 |
| 6,250,012 | B1 * | 6/2001 | Ricci | 49/87.1 |
| 6,418,665 | B1 * | 7/2002 | Gabriele | 49/87.1 |
| 6,901,988 | B2 * | 6/2005 | Colson et al. | 160/168.1 R |
| 7,544,893 | B2 * | 6/2009 | Wallgren et al. | 174/93 |
| 7,607,261 | B2 * | 10/2009 | Marocco | 49/87.1 |

FOREIGN PATENT DOCUMENTS

| | | | |
|---|---|---|---|
| EP | 1816281 | A2 * | 8/2007 |
| GB | 2 109 448 | A | 6/1983 |
| GB | 2 135 044 | A | 8/1984 |
| GB | 2370598 | A | 7/2002 |
| GB | 2 374 376 | A | 10/2002 |
| WO | WO 9005602 | A1 * | 5/1990 |

* cited by examiner

*Primary Examiner* — Robert Canfield
*Assistant Examiner* — Charissa Ahmad
(74) *Attorney, Agent, or Firm* — Hamre, Schumann, Mueller & Larson, P.C.

(57) ABSTRACT

A solar-shading assembly for fastening to a support mullion, comprises an elongate louver member having longitudinal front and rear edges, an elongate cap element for extending along and covering the rear edge, a bracket which is connectable to the support mullion, and a fastening device for connecting the bracket to the rear edge of the louver member. The in use fastening device is coverable by the cap element so as to hide the fastening device from view. Preferably, at least part of the bracket is also coverable by the cap element so as to hide the said part of the bracket from view.

19 Claims, 3 Drawing Sheets

SOLAR-SHADING ASSEMBLY WITH HIDDEN FASTENING DEVICE

The present invention relates to a solar-shading assembly for fastening to a support mullion, the assembly having a hidden fastening device.

BACKGROUND OF THE INVENTION

Solar-shading is known, and is frequently used on the exterior of a building to prevent or limit directly incident solar energy on windows. Louvers are known which are supported at their lateral ends, and which can also be supported along their edge lengths.

However, in all cases, the brackets and fastenings are fully visible. From an aesthetic point of view, architects prefer to have as few of the fixings and fasteners on view as possible. When a louver is held at the longitudinal edge, the rotational load is such that bracket locations must necessarily be very close to prevent catastrophic mechanical failure.

The prior art arrangements are also bulky and reasonably complex, leading to increased manufacturing and customer costs.

The present invention seeks to provide a solution to these problems.

SUMMARY OF THE INVENTION

According to a first aspect of the invention, there is provided a solar-shading assembly for fastening to a support mullion, the assembly comprising an elongate louver member having longitudinal front and rear edges, an elongate cap element for extending along and covering the rear edge, a bracket which is connectable to the support mullion, and a fastening device for connecting the bracket to the rear edge of the louver member, the in use fastening device being coverable by the cap element so as to hide the fastening device from view.

According to a second aspect of the invention, there is provided a support mullion in combination with a solar-shading assembly according to the first aspect of the invention, wherein the bracket holds the louver member and cap element in close proximity whereby a lateral end edge of the cap element is abuttable with the support mullion.

According to a third aspect of the invention, there is provided a support mullion in combination with a solar-shading assembly in accordance with the first aspect of the invention, wherein the bracket holds the louver member and cap element spaced from the support mullion.

The invention will now be more particularly described, by way of example only, with reference to the accompanying drawings.

DESCRIPTION OF THE PREFERRED EMBODIMENTS

Figure 1:
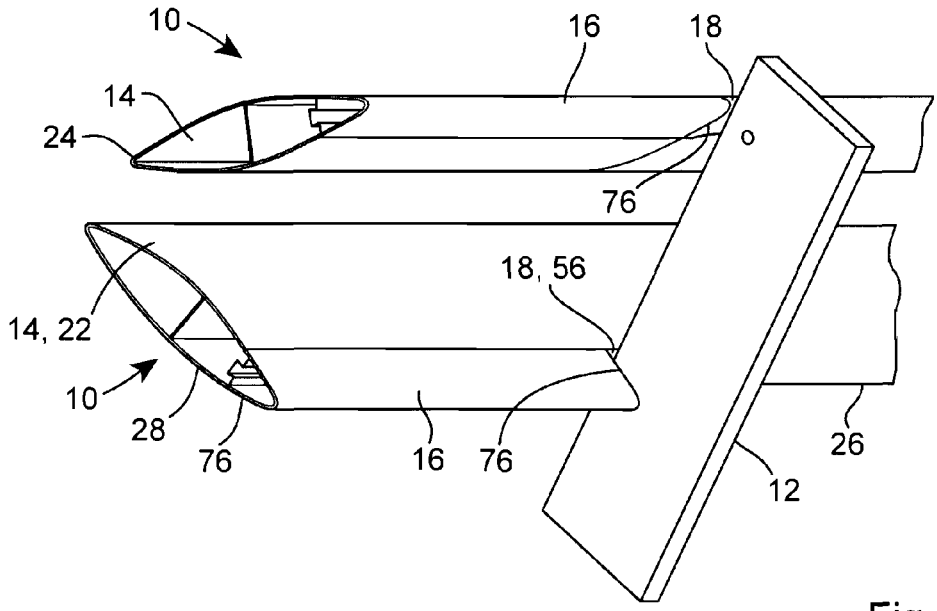
FIG. 1 is a partial perspective view from one side of first and second embodiments of solar-shading assemblies, in accordance with the first aspect of the invention.
Figure 2:
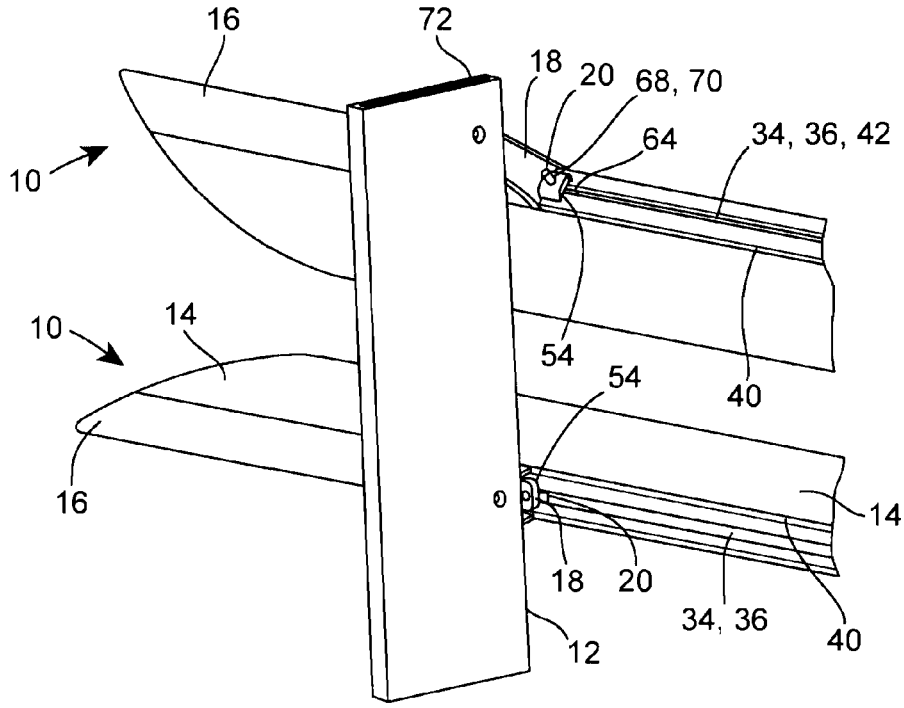
FIG. 2 is a view of the solar-shading assemblies, shown in FIG. 1, from the other side.
Figure 3:
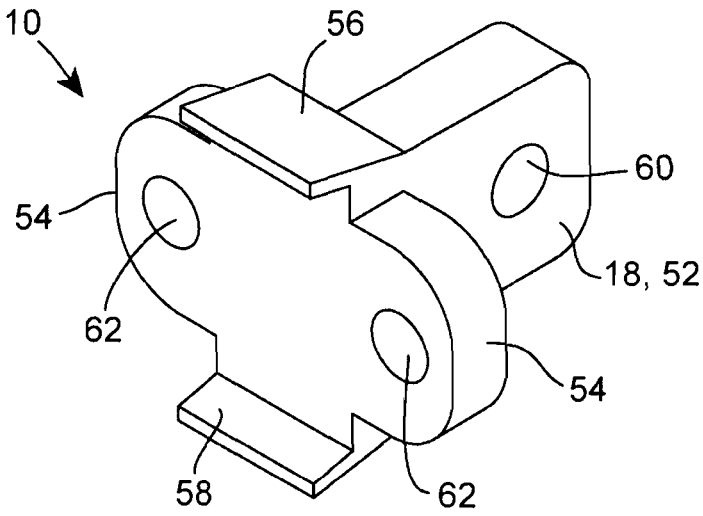
FIG. 3 is a perspective view of a bracket of the first embodiment of the solar-shading assembly, shown in FIG. 1.
Figure 4:
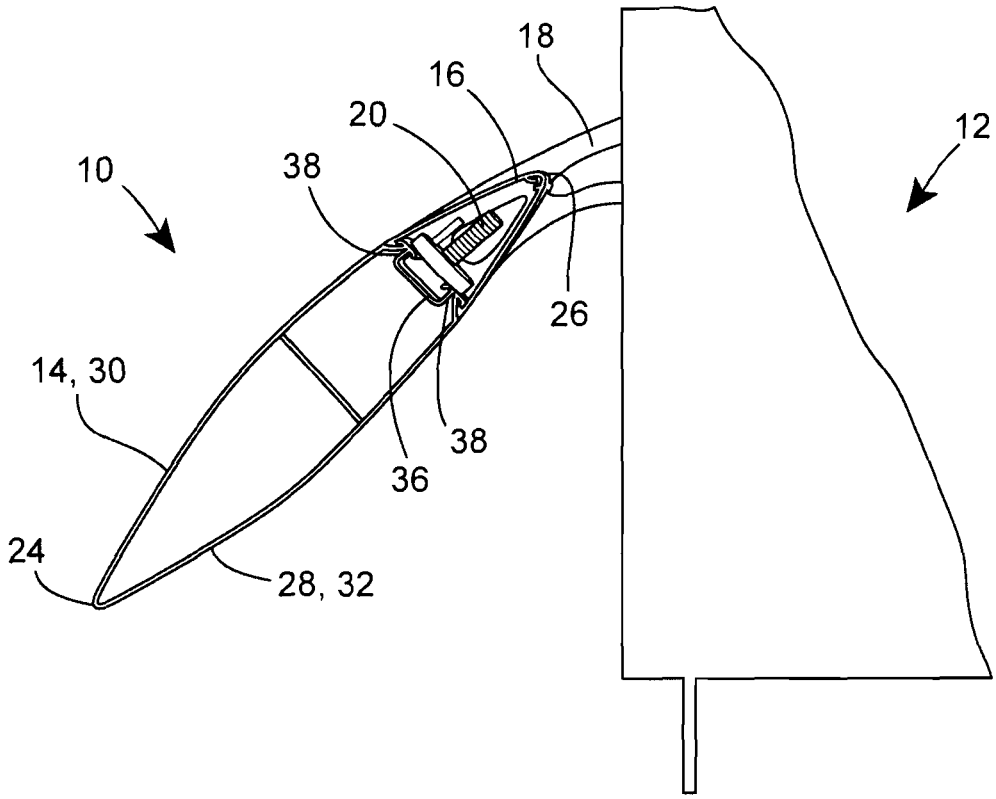
FIG. 4 is a lateral cross-sectional view of a louver member, showing a bracket of the second embodiment of the solar-shading assembly.

Referring firstly to FIGS. 1 to 3 of the drawings, there is shown a first embodiment of a solar-shading assembly 10 and a support mullion 12, typically fixed to project externally of a building. The solar-shading assembly 10 includes an elongate louver member 14, an elongate cap element 16, a bracket 18 for attachment to the support mullion 12, and a fastening device 20 for fastening the bracket 18 to the louver member 14.

The louver member 14, in this case, is one-piece and may be, for example, an extrusion from plastics or metal. Alternatively, the louver member 14 may be two-pieces, for example, an upper part and a lower part, connected together via snap-fitting and/or one or more screw-threaded fasteners.

The louver member 14 has an elongate body 22 with longitudinal parallel front and rear edges 24, 26, lateral end sides 28 which, if free, are typically capped, and upper and lower surfaces 30, 32 which span between the front and rear edges 24, 26 and end sides 28. In this case, a longitudinal extent of the louver member 14 is straight or rectilinear, but it may be curved in some cases. The upper surface 30 and a lower surface 32 of the louver member 14 have arcuate lateral extents which converge to a narrow edge to form the longitudinal front edge 24. The upper and lower surfaces 30, 32 taper towards each other, but remain spaced thereby providing a deep blunt longitudinal rear edge 26.

The rear edge 26 includes a channel 34 which is parallel with the front edge 24, and which runs the entire longitudinal extent of the louver member 14. The channel 34 includes a bottom surface 36 and two opposing side walls 38 which are adjacent to edges 40 of the upper and lower surfaces 30, 32 of the louver member 14. An opening 42 of the channel 34 faces away from the front edge 24. Leading edges of the side walls 38 have in-turned leading edge portions 44 which extend along the longitudinal extent of the louver member 14, whereby the channel 34 has a C-shaped or substantially C-shaped lateral cross-section.

Leading edges of the side walls 38 also have out-turned leading edge portions 46 which extend along the longitudinal extent of the louver member 14, and in parallel with the in-turned leading edge portions 44.

The cap element 16 has a V-shaped or substantially V-shaped lateral cross-section, and may be plastics or metal. Free leading edges 48 of the cap element 16 include in-turned edge portions 50 for snap-fit connection with the out-turned leading edge portions 46 of the louver member 14. With the cap element 16 connected to the rear edge 26 of the louver member 14, a louver having a symmetrical elliptical or substantially elliptical lateral cross-section is defined. A lateral cross-sectional shape of the cap element 16 matches or substantially matches a lateral shape of a front portion of the louver member 14 which includes the front edge 24.

The bracket 18 is best seen in FIG. 3, and comprises a mullion connector 52 and two arms, tabs or wings 54 which extend laterally in opposite directions from an end of the mullion connector 52. The bracket 18 is beneficially one-piece, preferably being cast or moulded metal, and also includes spaced forwardly-projecting upper and lower lips 56, 58 which extend from the mullion connector 52, between the wings 54. The mullion connector 52 includes at least one aperture 60 at one end opposite the end with the wings 54 for connection with the support mullion 12. The wings 54 also each include at least one aperture 62 to enable connection with the fastening device 20.

Figure 5:
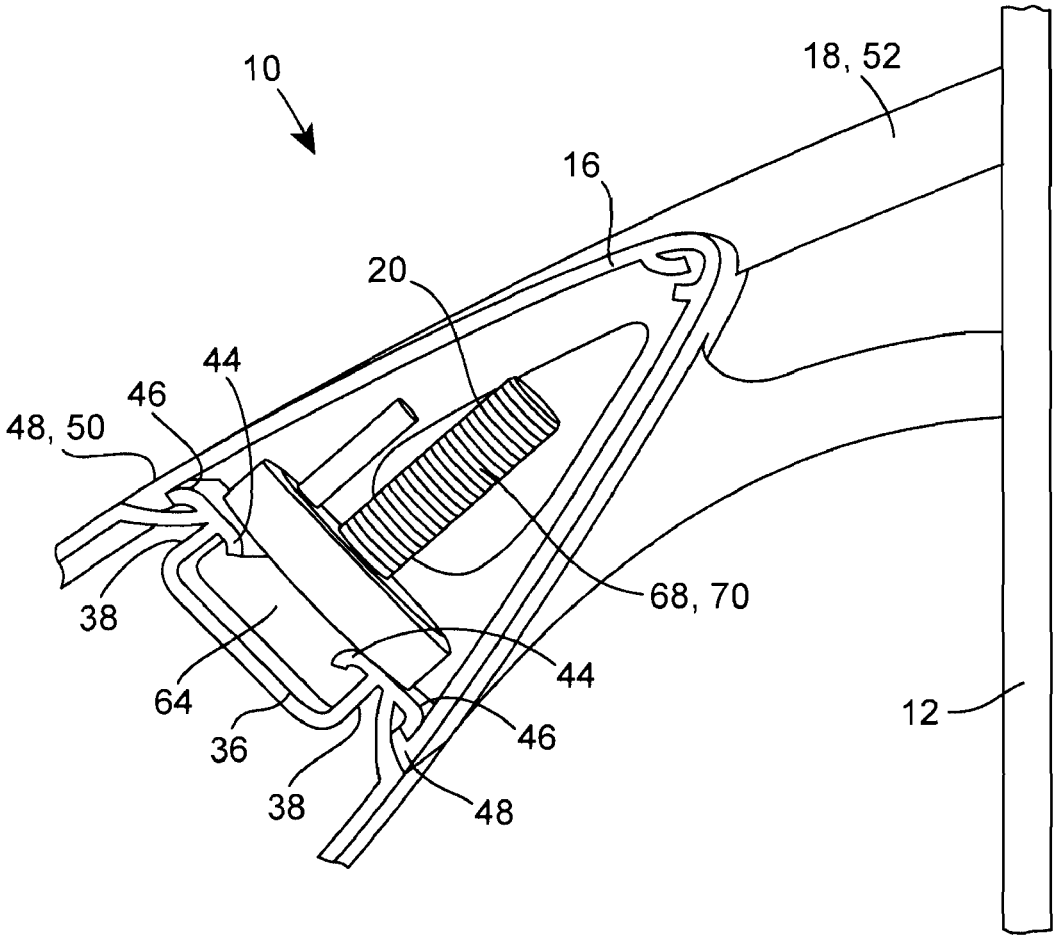
FIG. 5 is an enlarged view of part of the louver member, bracket and fastening device shown in FIG. 4.

The fastening device 20 includes an anchor element 64 (shown in FIG. 5) which is slidable in the channel 34 of the louver member 14. The anchor element 64 spans and overlaps the opening 42 of the channel 34 so as to engage the in-turned leading edge portions 44. Preferably, the anchor element 64 includes two spaced apertures therethrough for receiving two separate screw-threaded fasteners 68. The heads of the fasteners 68 may be recessed into the anchor element 64. The recesses may be complimentarily shaped to match non-circular heads of the fasteners 68 and thereby prevent rotation. The threaded shafts 70 project from the anchor element 64 and also from the channel 34.

In use, the anchor element 64 is slidably received in the channel 34 in the rear edge 26 of the louver member 14, typically by being inserted from one end of the channel 34 and slid therealong. The bracket 18 is loosely connected using nuts to the screw-threaded shafts 70 of the fasteners 68 projecting from the anchor element 64 and the channel 34. The louver member 14 is offered up to the support mullion 12, typically into a channel 72 of the support mullion 12, and the mullion connector 52 is connected thereto, for example, by a fastener which passes through the support mullion 12 and the mullion connector 52 therein.

With the bracket 18 connected to the support mullion 12, the wings 54 of the fastening device 20 are tightened to the anchor element 64 in the channel 34 of the rear edge 26, which effectively draws the louver member 14 into contact with or closely adjacent to the support mullion 12. Once tightened, the forwardly projecting lips 56, 58 of the bracket 18 overlap the rear edge 26 to abut edges 40 of the upper and lower surfaces 30, 32 of the louver member 14. The cap element 16 is preferably cut to length by the installer so as to fit closely between two adjacent support mullions 12. Each cap element 16 is then snap-fitted to the rear edge 26 of the louver member 14, so that the entire longitudinal extent of the rear edge 26 is covered and hidden by the cap elements 16, except for gaps which allow the mullion connectors 52 to project. Due to the lateral end sides 76 of the cap element 16 abutting or substantially abutting the support mullions 12, the wings 54 of the brackets 18, and thus also the fastening devices 20, are fully covered and hidden from view by the cap elements 16.

Referring to FIGS. 1, 2, 4 and 5, a second embodiment of the solar-shading assembly 10 is shown. Like references refer to like parts, and further detailed description is omitted. In this embodiment, a longitudinal extent of the mullion connector 52 of the bracket 18 is greater, allowing the louver member 14 and cap element 16 to be spaced from the support mullion 12. Each lateral end side 76 of the cap element 16 therefore abuts or substantially abuts the respective mullion connector 52 of the bracket 18, instead of the support mullion 12. Like the first embodiment, the cap element 16 covers the wings 54 of the brackets 18 at each end, and thus also the fastening devices 20. The fastening devices 20 are thus again fully covered and hidden from view.

The mullion connectors of the brackets may be straight or rectilinear, as in the first embodiment, or curved or arcuate as in the second embodiment. In either case, the mullion connector may be short enough to hold the louver member against or substantially against a front edge of the associated support mullion, whereby the lateral end side of the cap element abuts the side of the support mullion, or may be long enough to space the louver member and cap element away from the support mullion, so that the lateral end side of the cap element abuts the side of the mullion connector.

Although an anchor element is suggested having two threaded fasteners extending therefrom, the anchor element could simply be the head of a fastener or bolt, providing the channel opening defined by the in-turned leading edge portions of the sides of the channel is narrow enough. Alternatively, the anchor element may be integrally formed as one-piece with one or more screw-threaded shafts.

The anchor element may also be a block having one or more screw-threaded openings to receive a threaded shaft of a bolt or other fastener.

The anchor element may also include a coil spring on its back side to bias the anchor body against the in-turned leading edge portions of the sides of the channel.

Although the bracket includes two wings, only one wing may be provided. Each wing extends at right angles to the mullion connector. However, other angles can be envisaged, for example, if the louver member and the cap element are to extend around a corner.

The cap element is a snap fit, but may be fastened by additional or alternative means, such as bonding or screw-threaded fasteners.

The cap element is preferably V-shaped, to match a front edge portion of the louver member, but may be other shapes providing the fastening device can be hidden from view.

The louver member is preferably one-piece, but may comprise a main middle section with a secondary cap element being provided to form a tapering front edge. The rear edge cap element and the front edge cap element may be substantially the same as each other. This would enable louvers of greater lateral dimensions to be produced and installed.

Although the louver is elliptical, other shapes are feasible.

Preferably, a plurality of cap elements is used to cover the rear edge of the louver member. However, it may be possible to have a single cap element with openings to allow the mullion connector of the bracket to project therefrom.

It is thus possible to provide a solar-shading assembly which provides a hideable fastening device for holding the louver to the support mullion. The bracket and fastening device are resilient and compact, and therefore cost-effective to produce. The fastening device is held internally within the louver, which comprises the louver member and the cap element, and can thus be hidden from view. The bracket extends from between two adjacent cap elements, whereby the rear edge of the louver member is covered and hidden from view. The louver member is also one-piece or two-pieces, thereby reducing parts, increasing lightness, and increasing cost-effectiveness.

The embodiments described above are provided by way of examples only, and further modifications will be apparent to persons skilled in the art without departing from the scope of the invention as defined by the appended claims.

What is claimed is:

1. A solar-shading assembly for fastening to a support mullion, the assembly comprising:

an elongate louver member having longitudinal front and rear edges, an elongate cap element which extends along and covers the rear edge, a bracket which is connectable to the support mullion, and a fastening device which connects the bracket to the rear edge of the louver member, the in use fastening device being coverable by the cap element so as to hide the fastening device from view, wherein the rear edge of the louver member includes two opposing out-turned edges which are snap-fittably engagable with the cap element.

2. A solar-shading assembly as claimed in claim 1, wherein at least part of the bracket is coverable by the cap element so as to hid the said part of the bracket from view.

3. A solar-shading assembly as claimed in claim 1, wherein the cap element has a lateral shape which matches or substantially matches a lateral shape of a front portion of the louver member which includes the front edge.

4. A solar-shading assembly as claimed in claim 1, wherein the louver member with the cap element attached defines an elliptical or substantially elliptical lateral shape.

5. A solar-shading assembly as claimed in claim 1, wherein the louver member is one-piece.

6. A solar-shading assembly as claimed in claim 1, wherein the rear edge of the louver member has a channel which receives part of the fastening device.

7. A solar-shading assembly as claimed in claim 6, wherein the channel includes two opposing in-turned edges which retain the part of the fastening device.

8. A solar-shading assembly as claimed in claim 6, wherein the fastening device includes an anchor element which is slidable in the channel.

9. A solar-shading assembly as claimed in claim 8, wherein the fastening device includes at least one screw-threaded fastener which extends from the anchor element.

10. A solar-shading assembly as claimed in claim 9, wherein two said screw-threaded fasteners are provided.

11. A solar-shading assembly as claimed in claim 1, wherein the bracket includes at least one lateral wing which is fastenable to the rear edge of the louver member by the fastening device.

12. A solar-shading assembly as claimed in claim 11, wherein two lateral wings are provided and which extend in opposite directions.

13. A solar-shading assembly as claimed in claim 1, wherein the cap element includes a channel in which part of the fastening device is receivable.

14. A solar-shading assembly as claimed in claim 13, wherein the channel of the cap element is adapted to receive part of the bracket.

15. A solar-shading assembly as claimed in claim 1, wherein the bracket includes at least one forwardly projecting lip which is extendable over the rear edge of the louver member.

16. A solar-shading assembly as claimed in claim 1, wherein a plurality of said cap elements cover substantially the entire rear edge of the louver member.

17. A solar-shading assembly as claimed in claim 16, wherein the bracket projects from between adjacent cap elements.

18. A support mullion in combination with a solar-shading assembly as claimed in claim 1, wherein the bracket holds the louver member and cap element in close proximity whereby a lateral end edge of the cap element is abuttable with the support mullion.

19. A support mullion in combination with a solar-shading assembly as claimed in claim 1, wherein the bracket holds the louver member and cap element spaced from the support mullion.

* * * * *